US010420977B1

(12) United States Patent
Sullivan

(10) Patent No.: US 10,420,977 B1
(45) Date of Patent: Sep. 24, 2019

(54) EXERCISE EQUIPMENT HAVING A CABLE SYSTEM AND METHODS OF ASSEMBLING EXERCISE EQUIPMENT HAVING A CABLE SYSTEM

(71) Applicant: Brunswick Corporation, Lake Forest, IL (US)

(72) Inventor: Todd R. Sullivan, Ramsey, MN (US)

(73) Assignee: Life Fitness, LLC, Rosemont, IL (US)

( * ) Notice: Subject to any disclaimer, the term of this patent is extended or adjusted under 35 U.S.C. 154(b) by 196 days.

(21) Appl. No.: 15/412,650

(22) Filed: Jan. 23, 2017

(51) Int. Cl.
*A63B 21/062* (2006.01)
*A63B 21/00* (2006.01)
*A63B 23/12* (2006.01)

(52) U.S. Cl.
CPC ..... *A63B 21/063* (2015.10); *A63B 21/00065* (2013.01); *A63B 21/00069* (2013.01); *A63B 21/0632* (2015.10); *A63B 21/154* (2013.01); *A63B 21/159* (2013.01); *A63B 21/4035* (2015.10); *A63B 21/4047* (2015.10); *A63B 23/1209* (2013.01)

(58) Field of Classification Search
CPC ..... A63B 21/063; A63B 23/1209; A63B 21/4047; A63B 21/4035; A63B 21/159; A63B 21/0632; A63B 21/00069; A63B 21/00065; A63B 21/154
See application file for complete search history.

(56) References Cited

U.S. PATENT DOCUMENTS

| | | | | |
|---|---|---|---|---|
| 4,978,261 | A * | 12/1990 | Wright, III | B23Q 16/001 408/241 S |
| 6,203,472 | B1 * | 3/2001 | McCaffrey | A63B 69/16 434/61 |
| 7,377,887 | B1 * | 5/2008 | Rosenow | A63B 21/155 482/134 |
| 7,413,532 | B1 * | 8/2008 | Monsrud | A63B 21/0628 482/98 |
| 7,491,155 | B2 * | 2/2009 | Fenelon | A63B 21/0601 482/107 |
| 9,192,800 | B1 * | 11/2015 | Meyer | A63B 71/0054 |
| 9,480,869 | B1 * | 11/2016 | Meyer | A63B 71/0054 |
| 2003/0096683 | A1 * | 5/2003 | Fenelon | A63B 21/0601 482/107 |
| 2009/0156376 | A1 * | 6/2009 | Fenelon | A63B 21/0601 482/108 |

* cited by examiner

*Primary Examiner* — Garrett K Atkinson
(74) *Attorney, Agent, or Firm* — Andrus Intellectual Property Law, LLP

(57) ABSTRACT

Exercise equipment comprises a resistance weight that is configured to oppose a given exercise motion via a cable system. An elongated cylindrical connector couples the resistance weight to the exercise equipment via the cable system. The elongated cylindrical connector comprises an externally threaded cylindrical surface that is engaged with a threaded recess on one of the exercise equipment and the resistance weight. A viewing window transversely extends into the threaded recess so that an operator can visually determine that the elongated cylindrical connector is fully engaged with the threaded recess when the externally threaded cylindrical surface is visible through said viewing window and so that an operator can visually determine that the elongated cylindrical connector is not fully engaged with the threaded recess when the externally threaded surface is not visible through said viewing window.

16 Claims, 4 Drawing Sheets

EXERCISE EQUIPMENT HAVING A CABLE SYSTEM AND METHODS OF ASSEMBLING EXERCISE EQUIPMENT HAVING A CABLE SYSTEM

FIELD

The present disclosure relates to exercise equipment, including for example weight training equipment having a cable system and a resistance weight that resists an exercise movement performed by an operator. The present disclosure further relates to methods of assembling exercise equipment having a cable system and a resistance weight.

BACKGROUND

The following U.S. Patents are incorporated herein by reference in entirety:

U.S. Pat. No. 9,480,869 discloses exercise equipment having a weight stack that is configured to oppose a given exercise motion through a cable and pulley system and an elongated cylindrical connector connecting the cable to a weight stack. The elongated cylindrical connector comprises a first threaded portion located proximate to the weight stack and a second portion located distal from the weight stack. The first threaded portion is engaged with the weight stack and has a diameter that is greater than a diameter of the second portion such that an operator can visually determine whether the connector is fully engaged with a threaded receptacle in the weight stack.

U.S. Pat. No. 7,413,532 discloses exercise apparatus having a weight stack for opposing a given exercise motion. The weight stack has a first set of a plurality of primary weights vertically stacked on each other, a primary weight selector having a plurality of settings selectively controlling the number of weights to be lifted during the exercise motion, a second set of a plurality of secondary weights, and a secondary weight selector having a plurality of settings selectively controlling the number of secondary weights to be lifted during the exercise motion, the secondary weights providing supplemental incremental weight.

U.S. Pat. No. 7,377,887 discloses exercise apparatus for guided exercise movement including a primary arm pivotally mounted to a frame for pivotal movement about a fixed pivot relative to the frame, a movement arm pivotally mounted to the primary arm for pivotal movement relative to the primary arm about a floating pivot relative to the frame, a stationary cam fixed on the frame, and a follower on the movement arm engaging the stationary cam and guided thereby to control the path of movement of the movement arm about the floating pivot during movement of the primary arm about the fixed pivot. The cam has a cam track surface controlling compound movement of the movement arm.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to non-limiting examples disclosed herein, exercise equipment comprises a resistance weight that is configured to oppose a given exercise motion via a cable system. An elongated cylindrical connector couples the resistance weight to the exercise equipment via the cable system. The elongated cylindrical connector comprises an externally threaded cylindrical surface that is engaged with a threaded recess on one of the exercise equipment and the resistance weight. A viewing window transversely extends into the threaded recess so that an operator can visually determine that the elongated cylindrical connector is fully engaged with the threaded recess when the externally threaded cylindrical surface is visible through said viewing window, and so that an operator can visually determine that the elongated cylindrical connector is not fully engaged with the threaded recess when the externally threaded surface is not visible through said viewing window.

In certain examples, the resistance weight comprises a weight stack having a plurality of weights that are configured to oppose a given exercise motion through the cable system. A head plate is disposed on the weight stack. A bayonet extends from the head plate into the weight stack. The elongated cylindrical connector connects the cable system to the bayonet and head plate. The elongated cylindrical connector comprises the externally threaded cylindrical surface which is engaged with the threaded recess on the one of the head plate and bayonet.

Corresponding methods of assembly are also disclosed.

BRIEF DESCRIPTION OF THE DRAWINGS

Examples of exercise equipment and connectors for exercise equipment, including weight training equipment having a cable system and resistance weight for resisting an exercise movement of an operator are described with reference to the following drawing figures. The same numbers are used throughout the drawing figures to reference like features and components.

DETAILED DESCRIPTION OF THE DRAWINGS

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

Figure 1:
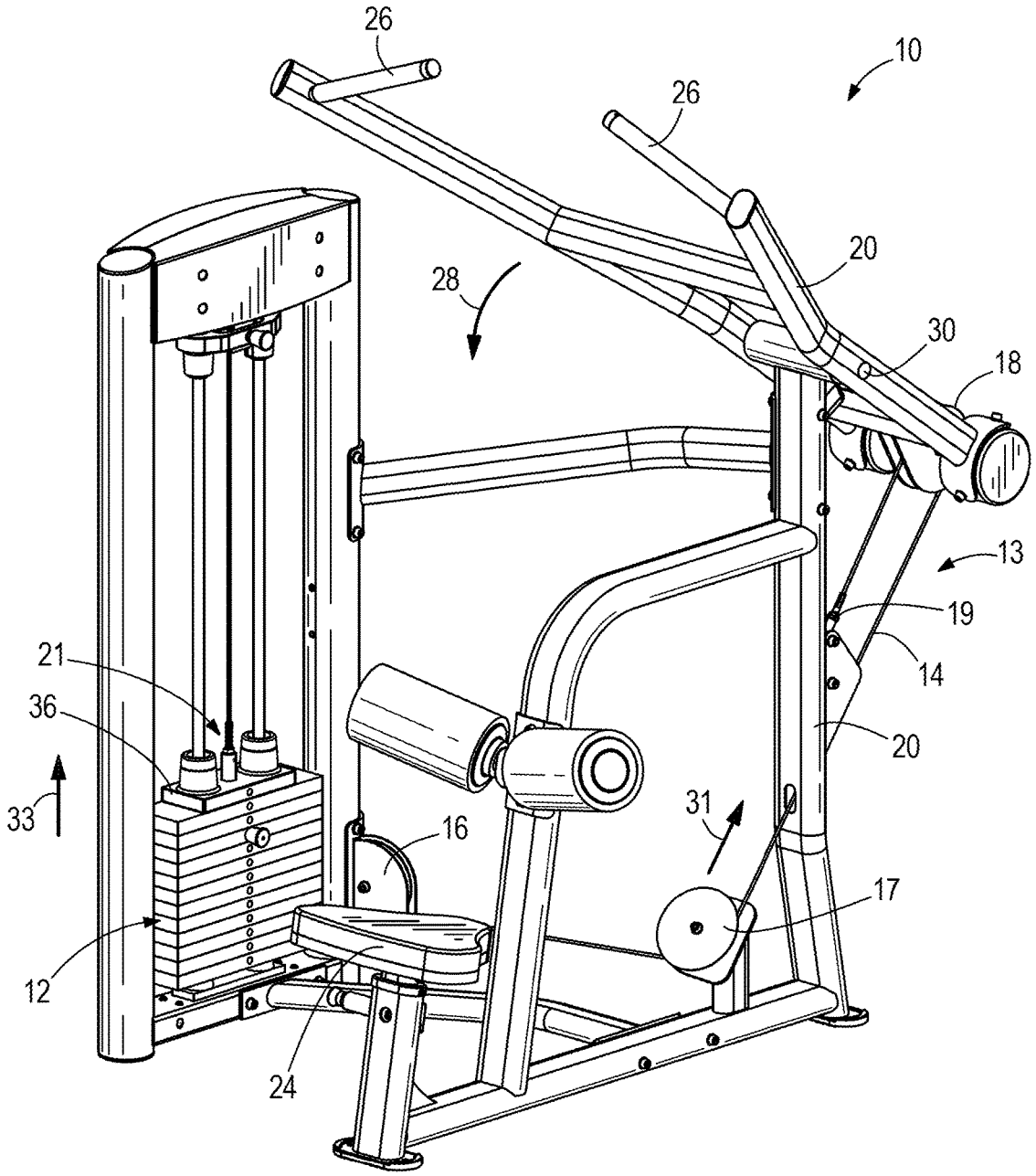
FIG. 1 is a perspective view of exemplary exercise equipment.
Figure 2:
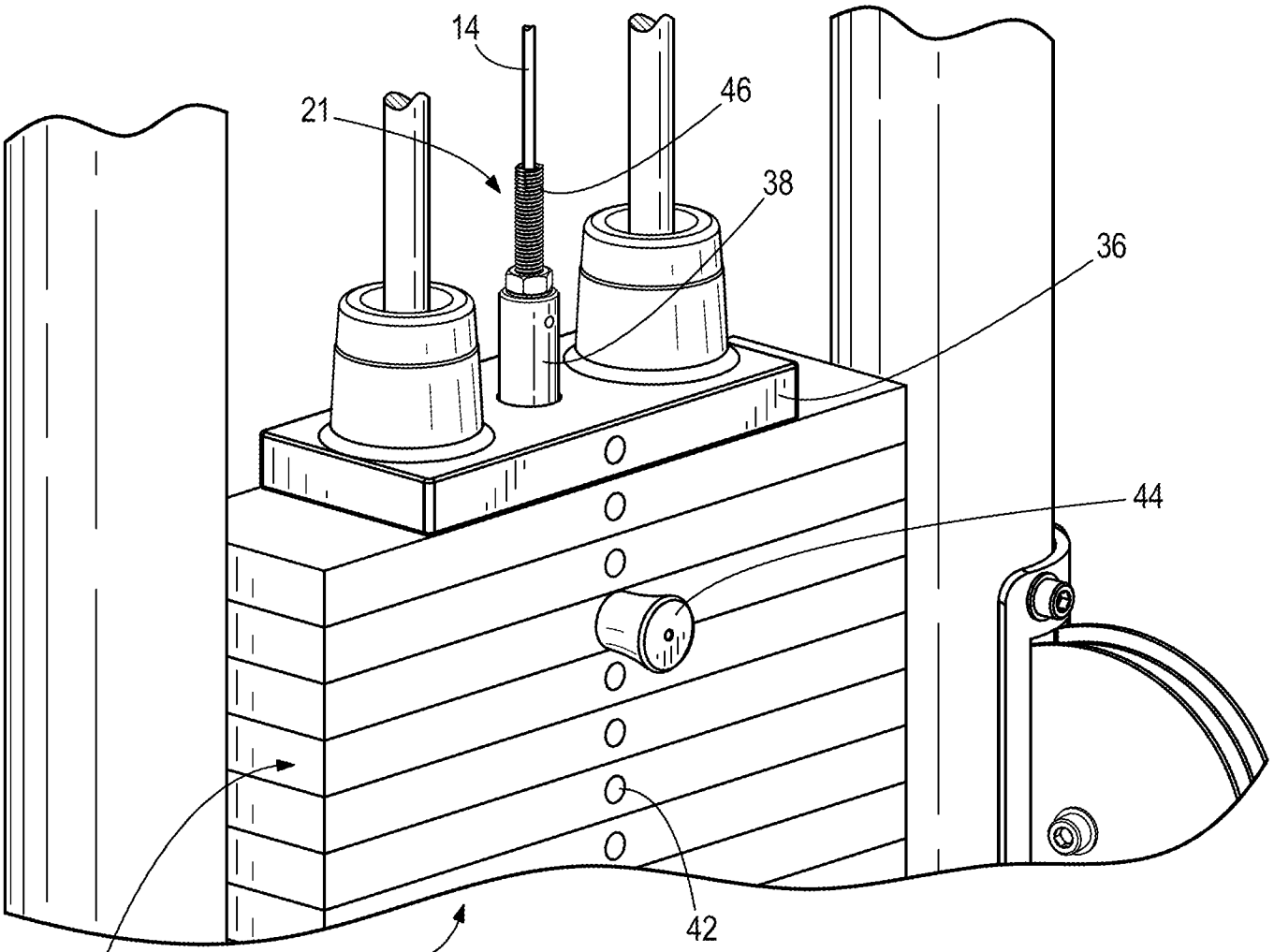
FIG. 2 is a closer view of a cable system and weight stack on the exercise equipment.
Figure 3:
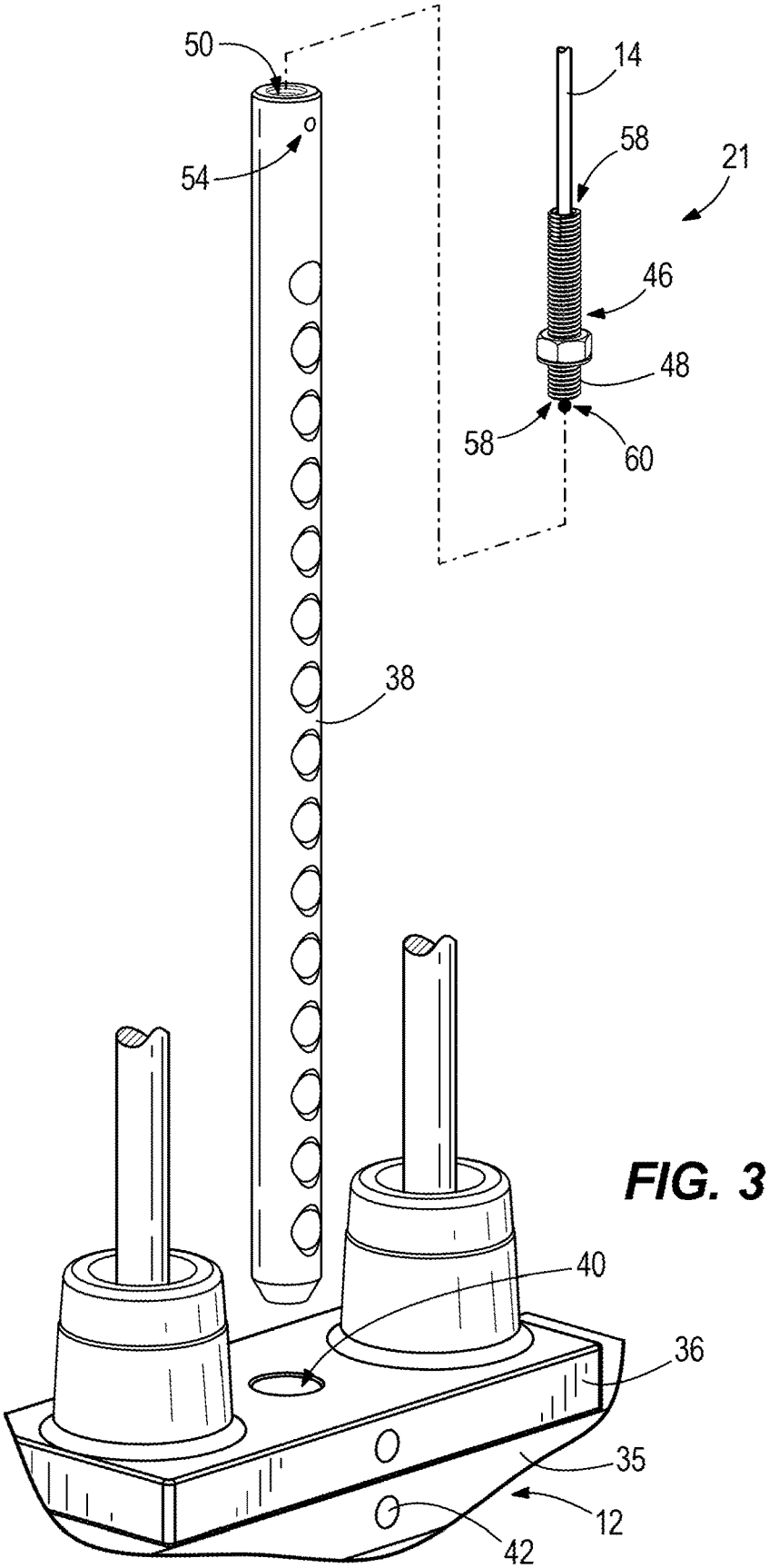
FIG. 3 is an exploded view of a head plate, bayonet and connector apparatus according to the present disclosure.

FIG. 1 depicts exercise equipment 10 in the form of a lat pull-down machine. The exercise equipment incorporates a resistance weight, which in this example includes a weight stack 12. The resistance weight is configured to oppose a given exercise motion performed by an operator via a cable system 13, including e.g., a cable 14 trained around several pulleys 16, 17, 18. The present disclosure is applicable to a wide variety of other types of exercise equipment, in addition to lat pull-down machines, such as for example, leg press machines, chest press machines, arm curl machines, and/or the like. That is, the lat pull-down machine shown in FIG. 1 is exemplary and for discussion purposes only. The present disclosure can be implemented with most other types of exercise equipment that incorporates a cable system and any type of resistance weight.

In the illustrated example, the cable 14 is connected at one end 19 to a frame 22 of the exercise equipment 10 and trained around a pivot arm 20 that is configured to pivot about the frame 22. The cable 14 is connected at its opposite free end 21 to the weight stack 12, which will be described further herein below. The exercise equipment 10 includes the frame 22 and a supporting seat 24 upon which an operator sits. In use, the operator grasps the handles 26 of the pivot arm 20 and pulls generally downwardly in the direction of arrow 28. This causes the pivot arm 20 to pivot with respect to the frame 22 at pivot point 30. Pivot arm 20 pulls upwardly on the cable 14 via the pulley 18, in the direction of arrow 31. Upward force on the cable 14 is transferred via the noted cable system 13 to the weight stack 12 in the direction of arrow 33. Again, the lat pull-down machine shown in FIG. 1 is exemplary and for discussion purposes only and the present disclosure can be implemented with most other exercise equipment incorporating a cable system and resistance weight arrangement.

Through research and experimentation, the present inventors have determined that prior art connectors for connecting the ends of the cable 14 to the exercise equipment 10, including for example the frame 22, the pivot arm 20 and/or the resistance weight (here weight stack 12) have both functional and safety drawbacks. For example, prior art connectors typically consist of a cylindrical threaded stud. In use, the inventors have determined that it is difficult to ascertain whether there is sufficient length of engagement between the prior art threaded stud and its connection point on the exercise equipment 10. If not enough threads are engaged, the cable 14 may inadvertently disengage, causing the weight stack 12 to unexpectedly fall. This risks injury to the operator and/or damage to the exercise equipment.

FIGS. 2-5 depict portions of the weight stack 12 including a plurality of weights 35 that are configured to oppose the above-described exercise motion via the cable system 13. A head plate 36 is disposed on top of the weight stack 12. A bayonet 38 extends from the head plate 36 into a center hole 40 that extends through the weight stack 12, namely through each of the plurality of weights 35. As is conventional, each respective weight 35 in the weight stack 12 also has a transverse bore 42 extending to the center hole 40 and being sized to receive a manually-operable connector pin 44 to thereby couple the respective weight 35 and all of the weights located above the respective weight 35 to the bayonet 38.

An elongated cylindrical connector 46 is connects the cable 14 to the head plate 36 and bayonet 38. The elongated cylindrical connector 46 includes an externally threaded cylindrical surface 48 that is engaged with a threaded recess 50 on the axially upper end 52 of the bayonet 38. In the illustrated example, the elongated cylindrical connector 46 includes a stud having an axial throughbore 58 extending there through. The cable system 13 has a cable 14 that extends completely through the axial throughbore 58. The cable 14 has a free end 60 that is sized larger than the diameter of the axial throughbore 58 along the externally threaded cylindrical surface 48, such that the free end 60 engages with the stud and cannot pass through the axial throughbore 58. In the illustrated example, the free end 60 is spherically shaped (e.g., a swaged ball-end).

According to the present disclosure, a viewing window 54 extends through the bayonet 38 and perpendicularly into the threaded recess 50. The viewing window 54 is axially spaced apart from the axially upper end 52 of the bayonet 38 by a distance that corresponds to a fully registered position for the elongated cylindrical connector 46. For example, the viewing window 54 can be spaced apart from the axially upper end 52 of the bayonet 38 by at least ½ inch, which has been found to correspond to a safely registered position of the elongated cylindrical connector 46. In the illustrated example, the viewing window 45 has a circular cross-section with a 3/16 inch diameter; however the shape and size of the viewing window can vary from what is shown. In this manner, the viewing window 54 is configured so that during and after assembly an operator can visually determine that the elongated cylindrical connector 46 is fully engaged with the threaded recess 50 when the externally threaded cylindrical surface 48 is visible through the viewing window 54, and so that during and after assembly an operator can visually determine that the elongated cylindrical connector 46 is not fully engaged with the threaded recess 50 when the externally threaded cylindrical surface is not visible through the viewing window 54.

Figure 4:
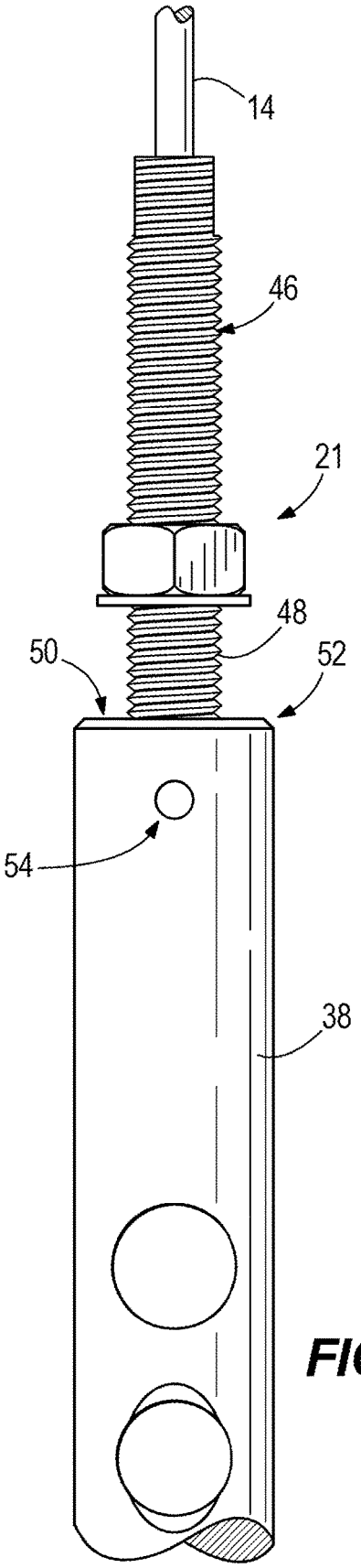
FIG. 4 is an elevation view of the cable, top of the bayonet and the connector apparatus prior to assembly thereof.
Figure 5:
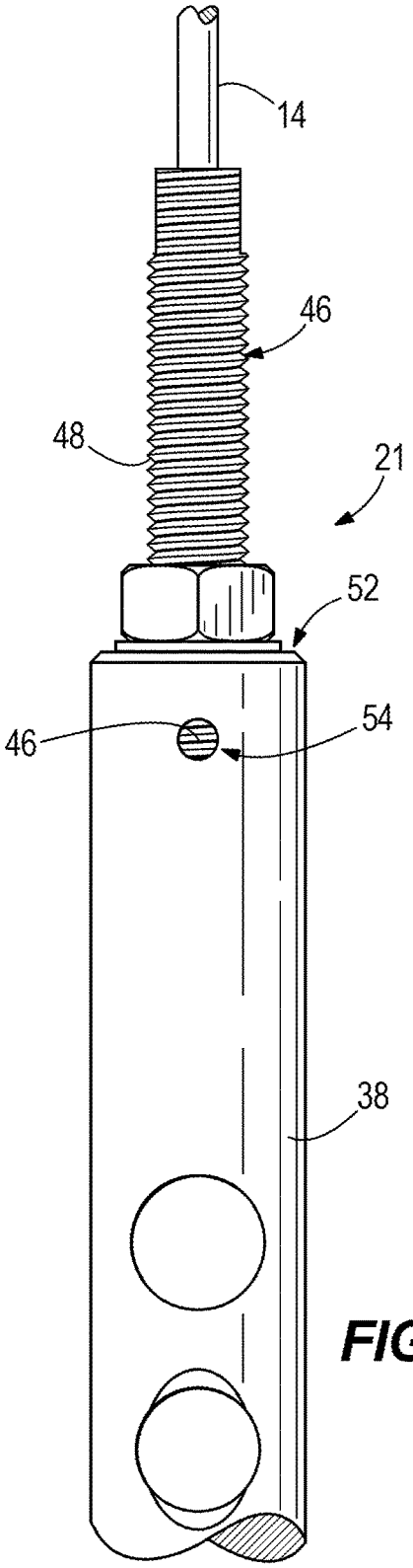
FIG. 5 is an elevation view of the cable, top of the bayonet and the connector apparatus after assembly thereof.

FIG. 4 depicts the elongated cylindrical connector 46 in a position in which it is not fully connected with the bayonet 38. As shown in FIG. 4, the elongated cylindrical connector 46 is not visible in the viewing window 45. FIG. 5 depicts the elongated cylindrical connector 46 in a fully engaged position with the bayonet 38, wherein the elongated cylindrical connector 46 is visible in the viewing window 45. It should be understood that the present invention is also applicable to the opposite connection point of the cable 14 on the exercise equipment 10, e.g., the frame 22 (shown at 19) or the pivot arm 20. In other examples, the present invention can be utilized at various other connection points for cable systems on exercise equipment.

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

What is claimed is:

1. Exercise equipment comprising:

a resistance weight that is configured to oppose a given exercise motion via a cable system;

an elongated cylindrical connector that couples the resistance weight to the exercise equipment via the cable system, wherein the elongated cylindrical connector comprises an externally threaded cylindrical surface that is engaged with a threaded recess on one of the exercise equipment and the resistance weight; and a viewing window that transversely extends into the threaded recess so that an operator can visually determine that the elongated cylindrical connector is fully engaged with the threaded recess when the externally threaded cylindrical surface is visible through said viewing window and so that an operator can visually determine that the elongated cylindrical connector is not fully engaged with the threaded recess when the externally threaded surface is not visible through said viewing window;

wherein the viewing window is spaced apart from an end of the one of the exercise equipment and the resistance weight by a distance that corresponds to a fully registered position of the elongated cylindrical connector.

2. The exercise equipment according to claim 1, wherein the resistance weight comprises a weight stack and wherein the threaded recess is on a bayonet that extends into the weight stack.

3. The exercise equipment according to claim 1, wherein the resistance weight comprises a weight stack and wherein the threaded recess is on a head plate that rests on top of the weight stack.

4. The exercise equipment according to claim 1, wherein the elongated cylindrical connector comprises a stud having an axial through-bore extending there-through, and wherein the cable system has a cable that extends completely through the through-bore.

5. The exercise equipment according to claim 4, wherein the cable has a free end that is sized larger than a diameter of the through-bore along the first threaded cylindrical portion such that the free end engages with the first threaded cylindrical portion and cannot pass through the through-bore.

6. The exercise equipment according to claim 1, wherein the viewing window has a circular cross-section.

7. The exercise equipment according to claim 1, wherein the viewing window perpendicularly extends into the threaded recess.

8. Exercise equipment comprising:

a weight stack having a plurality of weights that are configured to oppose a given exercise motion through a cable system;

a head plate disposed on the weight stack;

a bayonet that extends from the head plate into the weight stack;

an elongated cylindrical connector that couples the cable system to the bayonet and head plate, wherein the elongated cylindrical connector comprises an externally threaded cylindrical surface that is engaged with a threaded recess on one of the head plate and bayonet; and a viewing window that transversely extends into the threaded recess so that during assembly an operator can visually determine that the elongated cylindrical connector is fully engaged with the threaded recess when the externally threaded cylindrical surface is visible through said viewing window, and so that during assembly an operator can visually determine that the elongated cylindrical connector is not fully engaged with the threaded recess when the externally threaded cylindrical surface is not visible through said viewing window;

wherein the viewing window is spaced apart from an end of the one of the head plate and bayonet by a distance that corresponds to a fully registered position for the elongated cylindrical connector.

9. The exercise equipment according to claim 8, wherein the elongated cylindrical connector comprises a stud having an axial through-bore extending there-through, and wherein the cable system has a cable that extends completely through the through-bore.

10. The exercise equipment according to claim 9, wherein the cable has a free end that is sized larger than a diameter of the through-bore along the externally threaded cylindrical surface such that the free end engages with the stud and cannot pass through the through-bore.

11. The exercise equipment according to claim 10, wherein the free end is spherically shaped.

12. The exercise equipment according to claim 8, wherein each respective weight in the plurality of weights has a transverse bore that is sized to receive a connector pin to thereby couple the respective weight to the bayonet.

13. The exercise equipment according to claim 8, wherein the exercise equipment comprises a press arm.

14. The exercise equipment according to claim 8, wherein the cable system comprises a pulley.

15. The exercise equipment according to claim 8, wherein the viewing window perpendicularly extends into the threaded recess.

16. The exercise equipment according to claim 8, wherein the viewing window has a circular cross-section.

* * * * *